United States Patent [19]

Sit

[11] 4,302,798

[45] Nov. 24, 1981

[54] PAN FOR CEILING MOUNTED LIGHT FIXTURE

[75] Inventor: Hoffman Sit, Glenview, Ill.

[73] Assignee: McGraw-Edison Company, Rolling Meadows, Ill.

[21] Appl. No.: 137,901

[22] Filed: Apr. 7, 1980

[51] Int. Cl.[3] ..... F21S 1/02

[52] U.S. Cl. ..... 362/147; 362/294; 362/368; 362/373

[58] Field of Search ..... 362/294, 147, 368, 373

[56] References Cited

U.S. PATENT DOCUMENTS 4,044,246 8/1977 Docimo et al. ..... 362/294

4,104,713 8/1978 Chan et al. ..... 362/294

*Primary Examiner*—Stephen J. Lechert, Jr.

*Attorney, Agent, or Firm*—Ronald J. LaPorte; Jon C. Gealow; Charles W. MacKinnon

[57] ABSTRACT

A pan for a ceiling mounted light fixture includes a saucer-like canopy defining a mounting hole for receipt of a fastener to secure the light fixture to a ceiling support surface. A first layer of insulative material is received between the canopy and the ceiling surface. Descending arms spaced about the periphery of the canopy join the canopy to a housing portion which is suspended therefrom. The housing portion includes concentric outer and inner walls, the latter of which has an inwardly extending lip or ledge defining a shelf to support a second layer of insulative material disposed between the canopy and shelf. Electrical sockets for receiving incandescent lamps are mounted on the lower wall of the shelf and a glass or the like shade is received thereover and secured by screws extending through the outer wall of the housing portion. The double layers of insulative material serve as barriers to prevent damage to the ceiling surface from heat generated by the incandescent lamps of the light fixture.

9 Claims, 4 Drawing Figures

PAN FOR CEILING MOUNTED LIGHT FIXTURE

BACKGROUND OF THE INVENTION

This invention relates generally to a "pan" for a ceiling mounted light fixture and more particularly, to such a "pan" which limits the transfer of heat generated by the electric lamps of the light fixture to the ceiling support surface.

Conventionally, light fixtures which are mountable on ceilings or other flat support surfaces, include what is called in the lighting industry, a "pan" to provide support to the fixture and through which the electrical wiring connecting the lamp socket(s) of the fixture to an electrical junction box, pass. The "pan" is most commonly a relatively flat member which attaches along one surface thereof by screw fasteners or the like to the threaded tabs of an electrical junction box mounted in the ceiling and which also supports the lamp sockets of the fixture on the opposite surface thereof. A decorative glass or plastic shade or refractor is joined to the "pan" and extends downwardly therefrom in covering relation to the lamp sockets.

It has been determined that "pans" of the type described permit too great heat transfer from the lighted lamps of the fixture back to the ceiling support, even in the case where a layer of insulation is provided between the "pan" and ceiling. If the heat transferred to the ceiling becomes excessive, it is possible that the ceiling surface will be damaged or discolored. It is also possible that the lamp fixture could become a fire hazard.

In order to reduce the heat transferred to a ceiling support from a light fixture mounted thereon, light fixture "pans" have been designed which include separate sections which are joined together but in spaced relation. One of the sections is secured to the ceiling while the other section is suspended from the first-mentioned section and accommodates the lamp sockets of the fixture. An air space between the section helps to dissipate heat produced by the lighted lamps. Examples of such light fixtures are illustrated in U.S. Pat. Nos. 3,141,086 and 4,044,246.

Still other types of light fixture "pans" which employ air passages to dissipate heat produced in the fixture are known in the art. Such fixtures are shown, for example, in U.S. Pat. Nos. 2,512,948 and 3,189,740.

While the above described light fixtures do aid in the reduction of heat transferred from the lighted lamps to the fixture to the ceiling surface, the "pans" of the first discussed group of patents rely on heat dissipation by air circulation, the efficiency of which tends to be limited and the "pans" of the second group of patents are merely variations of the standard "pan" discussed initially and as such are not as effective in dissipating heat as is desired.

SUMMARY OF THE INVENTION

Accordingly, it is a primary object of the present invention to provide a new and improved "pan" for a ceiling mounted light fixture which provides effective heat dissipation without reliance on air flow therethrough.

It is another object of the present invention to provide a "pan" for a light fixture of the above-described type which is relatively simple in construction, effective to dissipate heat from the support surface on which the light fixture is mounted and yet provides a pleasing appearance.

Briefly, a "pan" for a ceiling mounted light fixture according to the invention is preferably of one piece construction and includes a central canopy defining a mounting hole for the receipt of a fastener to secure the light fixture to a ceiling or the like support surface, over an electrical junction box mounted in the ceiling. A first layer of fiberglass or the like insulative material is placed between the canopy and the ceiling. Arms join the central canopy to a housing portion having an outer rim, the last-mentioned housing portion being suspended in spaced relation by the arms from the ceiling mounted canopy. A shelf is defined on the housing portion within the rim. Lamp sockets of the fixture are mounted on a lower surface thereof. The shelf supports a second layer of insulative material between the sockets and canopy. A decorative shade, refractor or the like is attached to and supported by the housing portion. The "pan" according to the invention provides a two stage insulative barrier to the electrical junction box and ceiling surface on which the canopy is mounted, thereby limiting heat transfer thereto without relying on air movement to dissipate the heat from the fixture.

DETAILED DESCRIPTION OF THE DRAWINGS

Figure 1:
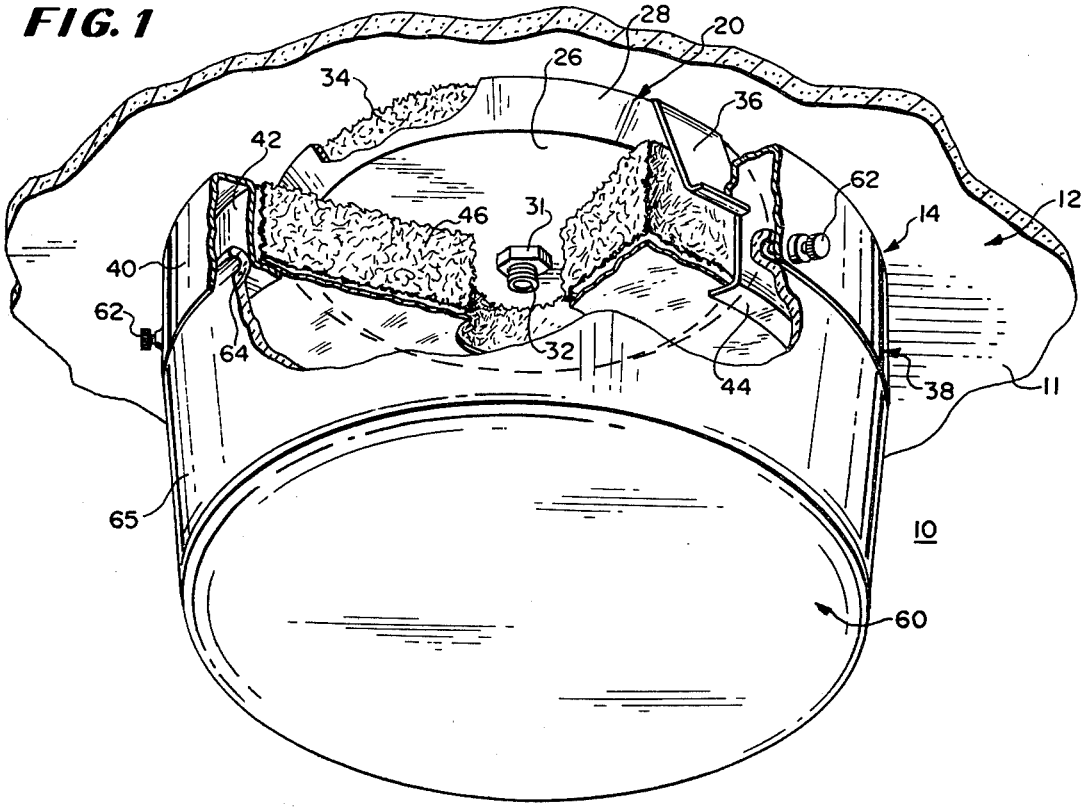
FIG. 1 is a partially cut away, bottom perspective view of a ceiling mounted lamp fixture including a new and improved pan according to the invention.

Referring now to the drawings in greater detail wherein like numerals are employed to designate similar components, there is illustrated in FIG. 1, a light fixture 10 suspended from a ceiling support surface 12. The light fixture 10 includes a pan 14 according to the invention, mounted on the outer surface 11 of ceiling 12 in covering relation with respect to an electrical junction box 15 mounted within the ceiling on the opposite, inner surface 13 thereof (See FIG. 2). Junction box 15 is of a conventional type affixed to a support beam 16 spanning ceiling joists 17, 19. An electrical conduit 18 coupled to the junction box via fitting 20 provides electrical power via wire leads 22, 24. A conventional fixture mounting strap 23 is fastened to the open end of junction box 14 by screws 25, 27.

Pan 14 according to the invention is preferably of one piece metal construction including an upper canopy 20, herein shown as being circular in shape, but which can take other shapes if desired. Canopy 20 includes a base wall 26 with a continuous upstanding side wall 28 extending about the periphery thereof. Sidewall 28 is relatively low, giving the canopy a saucer-like appearance. A central hole 30 is formed in basewall 26 for receipt of a threaded mounting bolt 32 for securing light fixture 10 on the outer surface 11 of the ceiling. The mounting bolt extends downwardly from strap 23 whereat it is secured by a nut 29. A second nut 31 retains the fixture at the opposite end of the bolt 32.

A layer of insulative material 34, preferably fiberglass or a similar substance, is placed within canopy 20 between basewall 26 and ceiling surface 11. Insulative material 34 provides a first insulative heat barrier in the light fixture.

A central hole 35 aligned with hole 30 in the canopy base wall, is defined in material 34 to permit passage of mounting bolt 32 therethrough.

A plurality of circumferentially spaced support arms 36 extend from the upper edge of sidewall 28 of the canopy, to joint the canopy to housing portion 38 of pan 12. The housing portion is suspended from arms 36 directly beneath canopy 20. In the preferred embodiment of the pan shown, housing portion 38 is also circular in shape and includes an outer sidewall or rim 40. The diameter of housing portion 38 is greater than that of canopy 20. In practice the diameter of the housing portions about 1½ times greater than that of the canopy. Formed as an integral portion of rim 40, concentrically, radially inwardly thereof is a second wall or rim 42. The inner and outer walls or rims 40, 42 are joined along the upper edges thereof by a horizontally disposed wall portion 43.

Rim 42 includes a radially inwardly extending lip or ledge 44, serving as a shelf upon which a secured layer 46 of insulative material is supported. Insulative layer 46 provides another second protective heat barrier for the light fixture. A central hole is provided in the insulative layer to permit access to nut 31, thereby enabling one to mount the pan on ceiling 12 as described heretofore.

Attached to the lower surface of shelf 44 are a pair of incandescent lamp receiving sockets 48, 50. The sockets are of a conventional design and are suspended from shelf 44 by mounting bracket legs 52, 54, respectively, the free ends of which are fastened by riveting, welding or the like to shelf 44. Conventional incandescent lamps 56, 58, (FIG. 2) are received in sockets 52, 54, respectively.

Wire leads 53, 55 of the lamp sockets extend from the latter through the pan into junction box 15 where they are connected to power leads 22,24 for providing electrical current to the lamps 56, 58.

Figure 2:
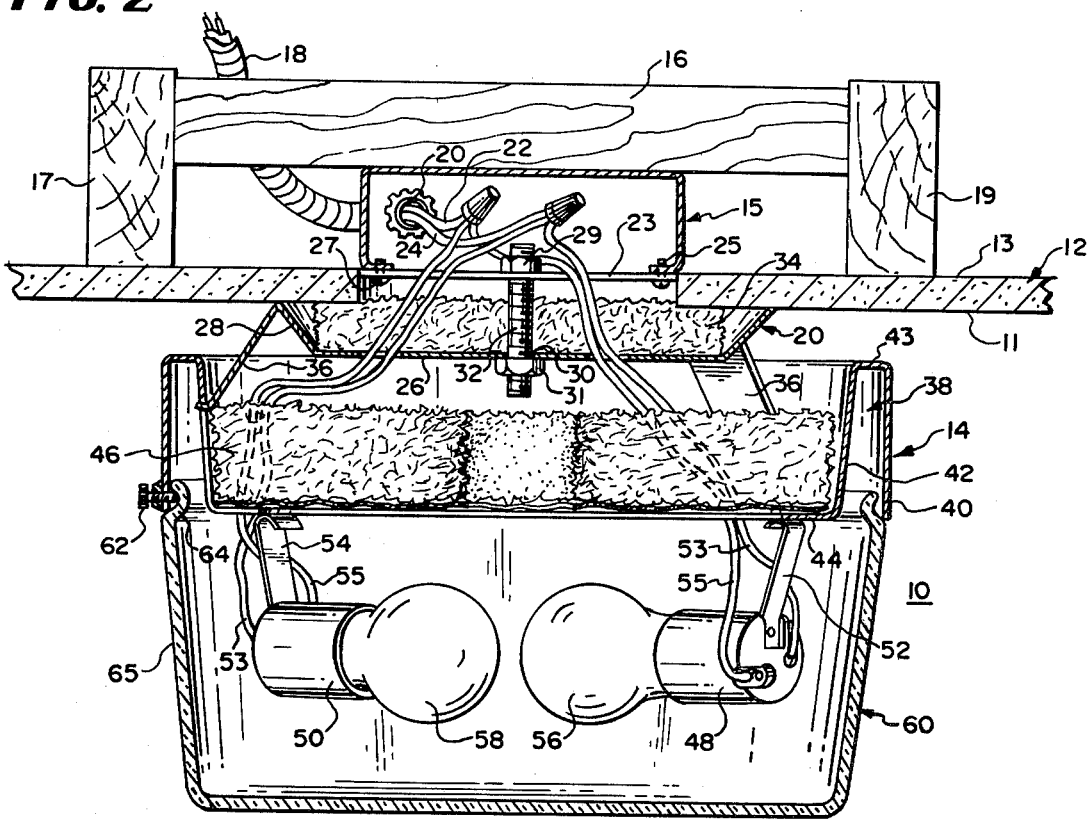
FIG. 2 is a side sectional view of the light fixture of FIG. 1.
Figure 3:
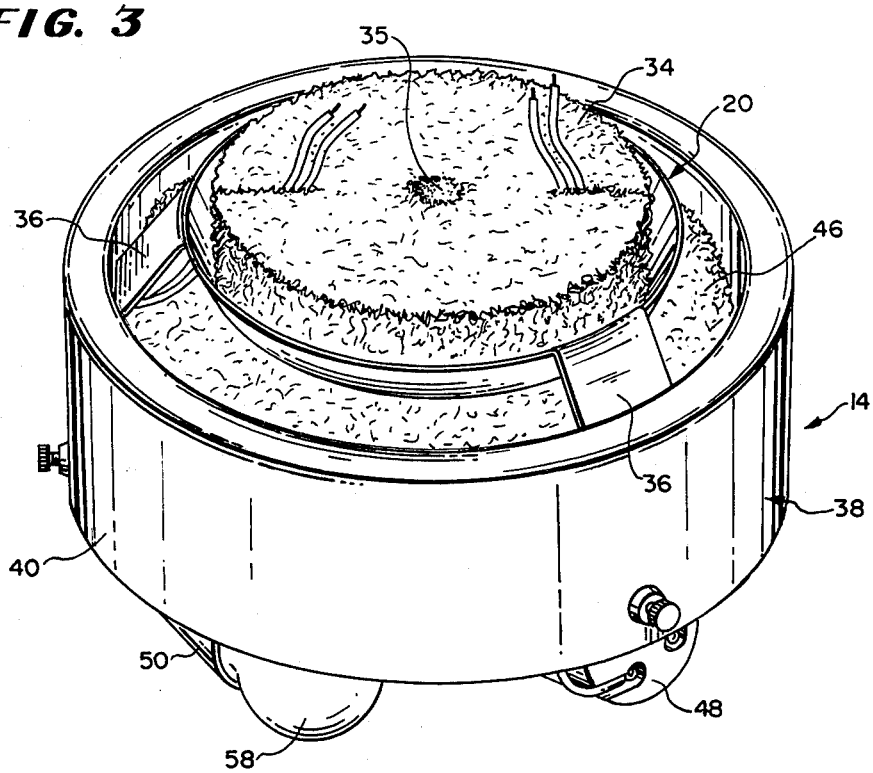
FIG. 3 is a top perspective view of the new and improved pan of the light fixture of FIG. 1.
Figure 4:
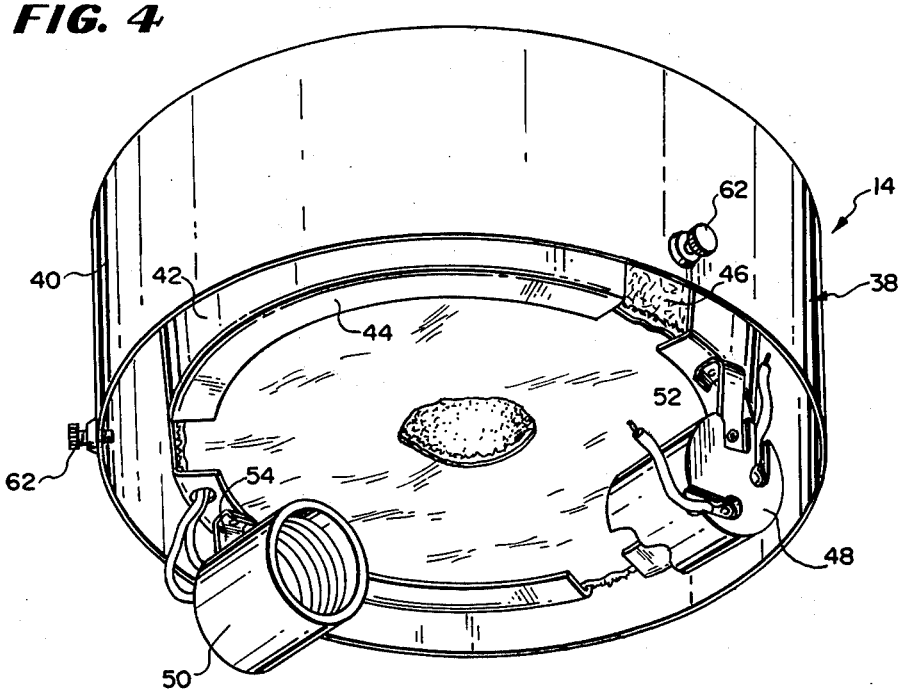
FIG. 4 is a bottom perspective view of the new and improved pan of the light fixture of FIG. 1.

A pot-shaped glass, plastic or the like decorative shade or refractor 60 is retained on the base portion of the pan in covering relation with respect to the lamp sockets as shown in FIG. 2, by conventional retaining screws received in threaded apertures placed about the outer rim or sidewall 40 of the housing portion. As shown in the drawings in FIGS. 1 and 2, the free end 64 of the sidewall 65 of the fixture shade includes a ridge in which screws 62 are received to secure the shade to housing portion 14 of the pan.

Functionally, the ceiling surface 12 on which the light fixture pan is mounted, is protected from the heat generated by lamps 56, 58 by the first and second spaced layers of insulative material 34, 46, respectively. Accordingly, the ceiling surface remains at a relatively cool temperature well below that necessary to scorch, discolor or burn the ceiling surface.

In practice, the upper insulative layer 34 is approximately three quarters of an inch in height while the lower insulative layer 46, providing the initial barrier against heat generated by lamps 56, 58, is approximately one inch in height. The lower insulative barrier 46, being of a diameter greater than that of insulative barrier 34, serves to dissipate heat initially generated by the lamps whereas insulative layer 34 protects the ceiling surface from any remaining heat not dissipated by the first insulative layer.

The combination of the barriers and their location in pan 14 of the light fixture provides ample heat protection to ceiling surface 12. While canopy 20 and housing portion 38 are separated by an air space, no reliance upon air flow through the space is made for dissipation of heat generated by the fixture lamps.

While the pan and light fixture have been illustrated as being circular in appearance, they may be formed in other shaped and still fall within the scope of the invention. It should be understood that many modificaions of the invention may be made and it is therefore contemplated to cover by the present application any and all such modifications as fall within the true scope and spirit of the invention.

I claim:

1. A light fixture for mounting on a ceiling or the like support surface including in combination;

a pan comprising a canopy portion mountable in contacting engagement with said support surface, a first layer of insulative material disposed between said canopy portion and said support surface, a housing portion having rim means, a support shelf extending generally horizontally inwardly within said rim means and arm means joining said canopy and housing portions, said housing portion being suspended from said canopy portion by said arm means, a second layer of insulative material supported on said shelf beneath said canopy and lampholder means mounted on said shelf on the surface thereof opposite said second insulative layer.

2. A light fixture as claimed in claim 1 wherein said first canopy portion has a first predetermined dimension wherein said housing portion has a dimension greater than said first canopy portion and wherein said arm means include a plurality of arms extending from said first canopy portion to said rim means of said housing portion for suspending the latter in spaced relation from said first canopy portion.

3. A light fixture as claimed in claim 1 wherein said canopy and housing portions are of circular shape, said canopy portion having a diameter shorter than the diameter of said housing portion.

4. A light fixture as claimed in claim 1 further including decorative shade means mounted on said housing portion in covering relation with respect to said lamp holder means.

5. A light fixture as claimed in claim 4 wherein said rim means includes a first outer rim and a second rim disposed concentrically inwardly thereof, said shelf extending from said inner rim inwardly of said housing portion, one of said inner and outer rims including fastening means for securing said shade to said housing portion.

6. A light fixture for mounting on a ceiling or the like support surface, including in combination:

a pan comprising a circular, saucer-like canopy having a basewall and an upstanding sidewall extending from the periphery of said basewall, said canopy mountable with the free end of said sidewall in contacting engagement with said support surface, a first layer of insulative material received in said canopy disposed between said basewall and said support surface, a housing having outer and inner concentric circular rims, the inner rim defining a support extending radially inwardly therefrom, arm means joining said canopy and housing for suspension of the latter from the former, a second layer of insulative material provided upon said support, lampholder means mounted beneath said support and being suspended downwardly and shade means mounted on said housing in covering relation with respect to said lampholder means.

7. A light fixture as claimed in claim 6 wherein said second insulative layer is predeterminedly spaced from said canopy and wherein said shade includes an outer sidewall of generally circular configuration, with the free edge of shade received between said outer and inner rims of said housing, one of said rims including fasteners to secure said shade to said housing.

8. A light fixture as claimed in claim 7 wherein said outer rim includes fasteners engageable with the sidewall of said shade to retain the latter on said housing.

9. A light fixture as claimed in claim 1 wherein the diameter of said housing and said second layer of insulative material is approximately 1.5 times greater than said canopy and first insulative layer, respectively.

* * * * *